US005566376A

United States Patent [19]

Dye et al.

[11] Patent Number: 5,566,376

[45] Date of Patent: Oct. 15, 1996

[54] ELECTROMAGNETIC COIL FOR USE IN A DOOR HOLDER SYSTEM

[75] Inventors: William P. Dye; Paul J. Hoggard, both of Indianapolis, Ind.

[73] Assignee: Von Duprin, Inc., Indianapolis, Ind.

[21] Appl. No.: 430,568

[22] Filed: Apr. 28, 1995

Related U.S. Application Data

[62] Division of Ser. No. 222,042, Apr. 4, 1994, abandoned.

[51] Int. Cl.[6] ..... H01F 7/18

[52] U.S. Cl. ..... 361/206; 361/144

[58] Field of Search ..... 70/280, 281, 282; 361/819, 142, 139, 206, 152, 160, 143, 144, 104; 335/285, 289, 290, 291; 327/525; 307/72–75; 292/251.5

[56] References Cited

U.S. PATENT DOCUMENTS

| | | | |
|---|---|---|---|
| 1,406,039 | 2/1922 | Lee | 361/104 X |
| 2,472,397 | 6/1949 | Bennett | 292/70 |
| 3,533,652 | 10/1970 | Crane et al. | 292/251.5 |
| 3,809,965 | 5/1974 | Groth et al. | 361/819 |
| 3,913,958 | 10/1975 | Larime | 292/251.5 |
| 4,400,761 | 8/1983 | Hayden et al. | 361/782 |
| 4,696,500 | 9/1987 | Zunkel | 292/251.5 |
| 4,811,157 | 3/1989 | Giordanino | 361/142 |
| 4,866,963 | 9/1989 | Leininger et al. | 70/282 X |
| 4,940,343 | 7/1990 | Kikuchi et al. | 361/160 X |
| 5,139,293 | 8/1992 | Zimmerman et al. | 292/251.5 |
| 5,170,322 | 12/1992 | Von Guttenberg | 361/819 X |

*Primary Examiner*—Fritz M. Fleming

*Attorney, Agent, or Firm*—Robert F. Palermo; A. James Richardson

[57] ABSTRACT

An electromagnetic coil for use in a doorholder for retaining a door in an open position by magnetic interaction with an armature secured to the door includes a coil of wire for surrounding a core within a cup. A power control circuit including a resistor circuit, controls electrical power supplied to the coil, the power control circuit being mounted on a circuit board situated between the coil rear surface and the cup bottom. The resistor circuit being situated in sufficiently close proximity to the cup bottom for transfer of heat from the resistor circuit to the cup. The power control circuit also includes a low resistance circuit coupled to the resistor circuit, the low resistance circuit including a fusible link, the fusible link being selected to carry current when the power input terminals are coupled to a lower voltage power source and to stop carrying current when the power input terminals are coupled to a higher voltage power source.

6 Claims, 2 Drawing Sheets

ELECTROMAGNETIC COIL FOR USE IN A DOOR HOLDER SYSTEM

This is a Division of application Ser. No. 08/222,042 filed Apr. 4, 1994, now abandoned.

BACKGROUND OF THE INVENTION

The present invention relates generally to door holders of the type employing an electromagnet to maintain a door such as a fire door in an open position and more particularly to a coil and power control circuit for such a door holder.

Door holders which incorporate an electromagnet are well known as shown in several U.S. patents. The door holder is typically employed with an armature assembly which is mounted to a door and is also well known in the art.

Generally, electromagnetic door holders are designed to be supplied electric power at 12, 24 or 120 volts. Some units are designed for operation with alternating current while other units rely on a supply of direct current. Some magnetic door holders are known which will work on either alternating or direct current by incorporating some sort of rectifier circuit.

In use, door holders typically operate in an essentially continuous fashion for maintaining fire doors and the like in an open position. In the event of a fire or other emergency, power supplied to the door holder is removed thus allowing the door to close under influence of a biasing force. Since the door holder in normal conditions is continuously operative, it is desirable to minimize the power requirement of the door holder to conserve electric power and the related costs.

The foregoing illustrates limitations known to exist in present devices and methods. Thus, it is apparent that it would be advantageous to provide an alternative directed to overcoming one or more of the limitations set forth above. Accordingly, a suitable alternative is provided including features more fully disclosed hereinafter.

SUMMARY OF THE INVENTION

A coil for an electromagnetic door holder system in accordance with the present invention includes a coil of wire, having first and second ends, wound around a hollow bobbin comprising a hollow member with first and second ends and first and second parallel flanges, respectively, extending radially outward therefrom, the first and second flanges being spaced from each other along the hollow member to receive the wire windings; a power control circuit mounted on a circuit board at the second end of the hollow member for controlling electrical power supplied to the coil.

Other features and advantages of the invention will become apparent to those skilled in the art upon consideration of the accompanying figures illustrating the preferred embodiment of the invention.

DESCRIPTION OF THE PREFERRED EMBODIMENT

Figure 1:
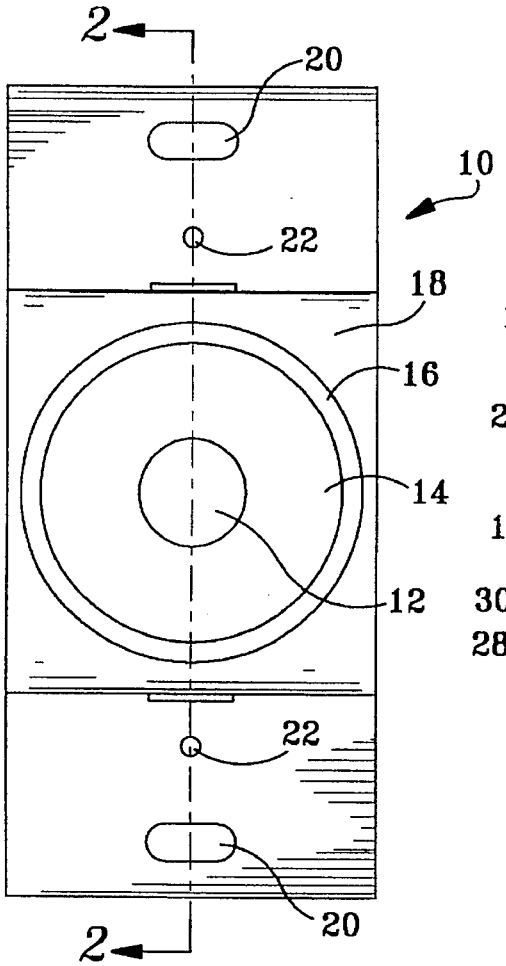
FIG. 1 is a front elevation view showing a magnetic door holder according to the present invention.

An electromagnetic door holder is shown in FIG. 1 to comprise a core 12 surrounded by a coil 14. The core and coil are received within cup 16 which is fixed to a bracket 18. The bracket 18 includes mounting holes 20 for mounting the bracket to a wall. The bracket 18 also includes holes 22 adapted to receive fasteners for securing a decorative facie (not shown) surrounding the cup 16 subsequent to attachment of the door holder to a supporting wall.

Figure 2:
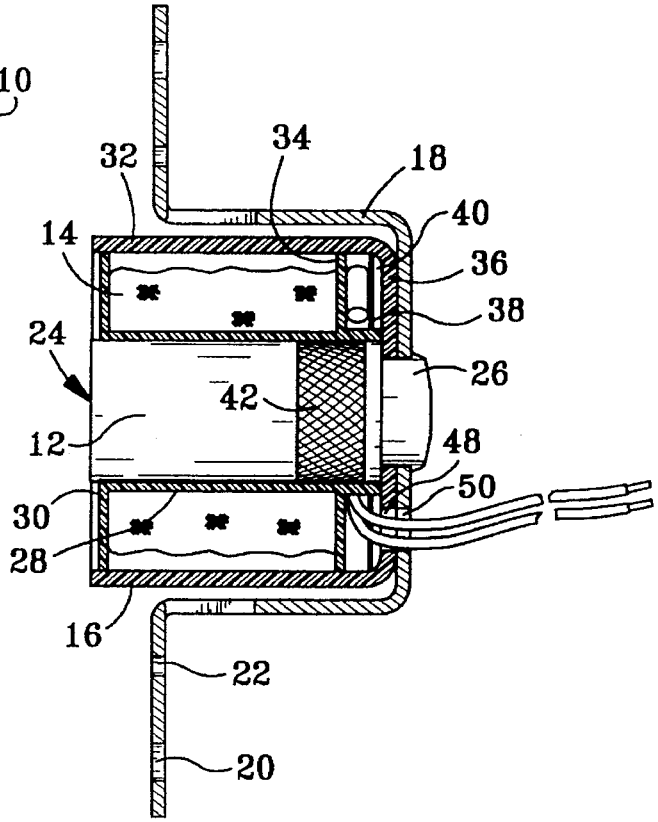
FIG. 2 is a sectional view of the door holder shown in FIG. 1 taken along lines 2—2.

Turning to FIG. 2, it will be noted that core 12 comprises a cylindrical body with a first end 24 intended to confront a mating armature (not shown) and a second end 26 which projects through an opening in the bottom of cup 16 and bracket 18. The end 26 is swaged or rolled outward to maintain the core 12, cup 16 and bracket 18 together as a single structural unit.

The coil 14 is shown to comprise a bobbin including a hollow cylindrical member 28. A first radial flange 30 extends radially outward from the front end of the hollow cylindrical member 28 from the core 12 to the wall 32 of cup 16. A second radial flange 34 extends outwardly from a position spaced some small distance from the bottom 36 of cup 16. A winding of wire forming the coil 14 is supported on the bobbin between the radial flanges 30 and 34. The end 38 of the coil bobbin abuts the bottom 36 of cup 16. The end 38 of the bobbin supports a printed circuit board 40 on which is mounted a power control circuit.

Figure 3:
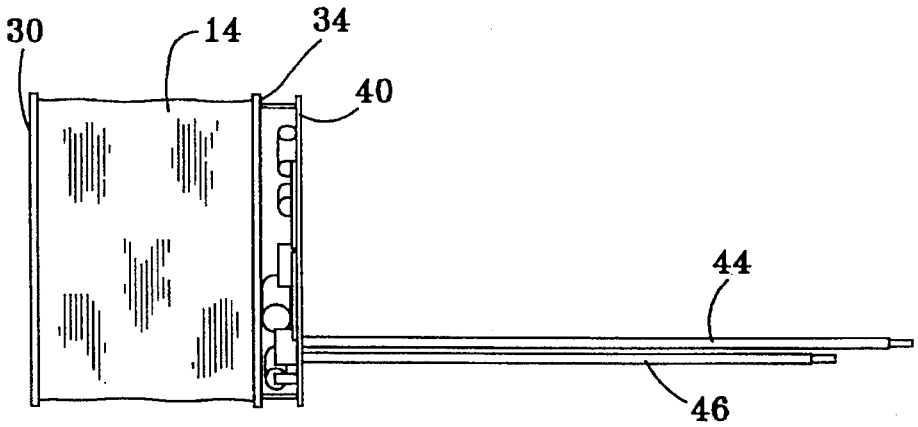
FIG. 3 is a side elevation view of the coil assembly shown in FIG. 2.

The bobbin including the coil and printed circuit board 40 constitutes a separate assembly shown in FIG. 3 which is inserted into cup 16 and held in place by frictional engagement between the cylindrical portion 28 of the bobbin and a knurled portion 42 of core 12. Power input terminals 44 and 46 project through small openings 48 and 50 in the bottom of the cup 16 and bracket 18 respectively.

Figure 4:
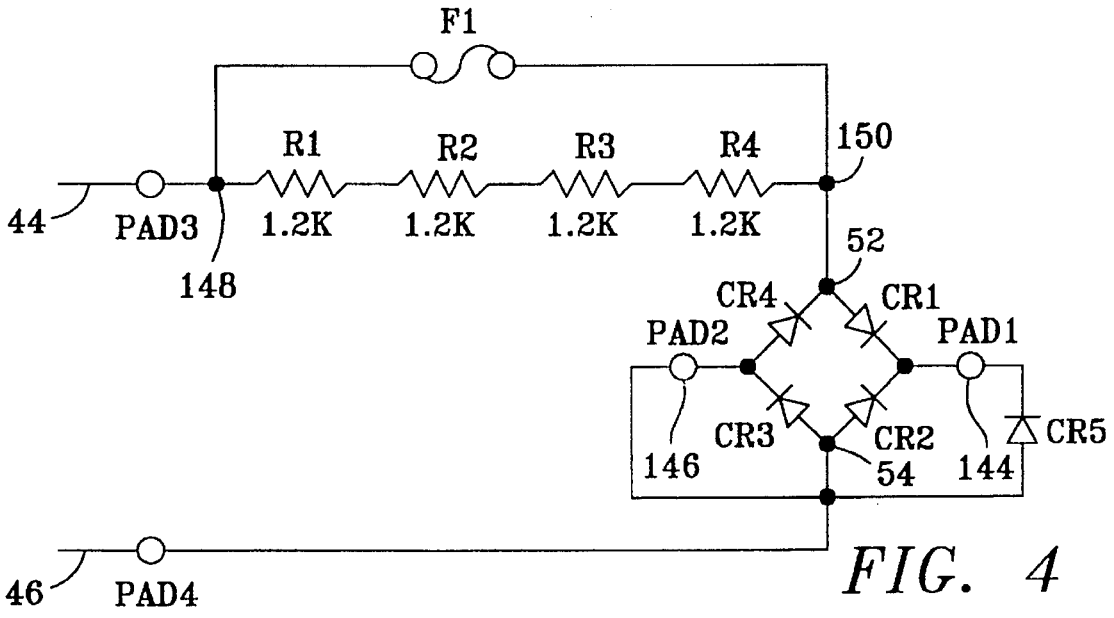
FIG. 4 is a schematic diagram of a power control circuit in accordance with the present invention.
Figure 5:
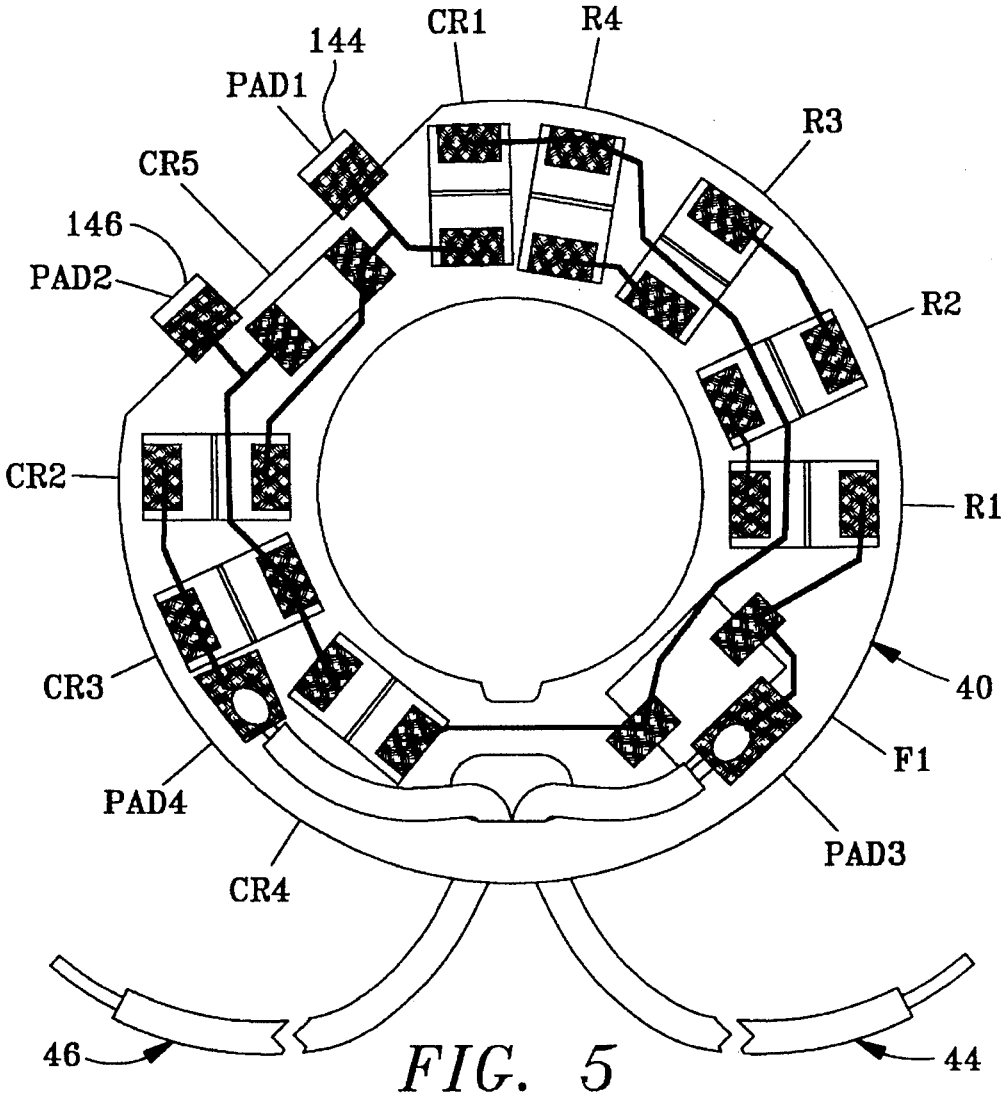
FIG. 5 is a plan view of the reverse side of a circuit board for the power control circuit shown in FIG. 4.

The power control circuitry mounted on printed circuit board 40 is shown schematically in FIG. 4. A layout design of the printed circuit board is shown in FIG. 5. A first power input terminal 44 is connected by way of PAD3 to input 148 of a resistor circuit shown to comprise resistors R1, R2, R3 and R4, shown here as four 1200 ohm resistors in series, totalling 4800 ohms and resulting in a 25 mA current under a 120 V potential. The four resistors are employed in preference to a single resistor to insure that adequate heat transfer can occur to the surrounding environment. The output of the resistor circuit 150 is coupled to an input 52 of a rectifier circuit formed by the four diodes CR1, CR2, CR3 and CR4. The second input 54 is coupled to the second of the power input terminals 46 at PAD4. The coil 14 for the electromagnet is coupled to the outputs 144, 146 of the rectifier circuit at PAD1 and PAD2, respectively.

A low resistance circuit including the fusible link F1 has first and second ends coupled between input 148 and output 150 of the resistor circuit, respectively. When input terminals 44 and 46 are connected to a low voltage power source such as a 24 volt source, current flows from the power input terminal 44 to the rectifier circuit by way of the low resistance circuit including fusible link F1. The current carrying capabilities of the fusible link are selected based on the internal resistance of the coil connected between pads 1 and 2 to insure the fusible link will continue to carry at this low input voltage the current necessary to power the electromagnet coil.

When the power input terminals 44 and 46 are connected to a higher voltage power source, for example a 120 volt power source, the current through the fusible link F1 of the low resistance circuit increases to such a point that the fusible link burns out and ceases to carry any current. As a result, the current from the power input terminal must traverse the resistors R1–R4 of the resistor circuit resulting in a potential drop between the input 148 and output 150 of the resistor circuit and insuring that the electromagnet coil will not be burned out. To insure the fusible link F1 will burn out fast enough to protect the coil, a zener diode CR5 is connected between PAD1 and PAD2. The zener diode preferably has an avalanche voltage of about one-half of the voltage of the higher voltage power source to which the circuit may be applied. Assuming the higher of the two voltages to which the circuit might be applied is 120 volts, the zener diode CR5 is selected to have an avalanche voltage of about 60 volts. When the power input terminals 44 and 46 are coupled to a 120 volt source, the voltage between PAD1 and PAD2 is sufficient to cause the zener to avalanche thus causing a momentary surge through the fusible link F1 which insures a faster than normal burnout of the fuse thus protecting the coil from any abnormally slow operation of the fuse F1.

In the preferred embodiment, the circuit is intended for use on either 24 or 120 volt sources. The zener is selected to have a 60 volt avalanche voltage. The coil is preferably one requiring not greater than 20 milliamps to develop the required magnetic field. In the preferred embodiment, the coil requires only 19 milliamps to develop a magnetic flux of approximately 10850 Gauss. In the preferred embodiment, the coil provides a holding force in the range of about 35 to 50 pounds as a result of developing a magnetomotive force of approximately 201 amp-turns. Thus, a current of 19 milliamps in a coil of nominally 10,600 turns will provide the desired holding force. The same force can, of course, be achieved by a coil of 8,000 turns at 25 milliamps or 10,000 turns at 20 milliamps. The specific method of achieving the approximately 10,000 Gauss and 200 amp-turns desired depends on desired mechanical and physical attributes of the coil such as size and mechanical durability, cost, and maximum $I^2R$-generated temperature rise which can be dissipated by the heat sink action of the cup 16 during operation.

It will be appreciated by those skilled in the art the same principles can be used with coils of different carrying capacity for use on other power sources. Other modifications and uses for the invention will become apparent from the disclosure to those skilled in the art which invention is defined by the following claims.

What is claimed is:

1. A coil assembly for use in an electromagnetic doorholder system with a variety of power sources, comprising:

a coil bobbin comprising a hollow member having first and second ends, a first flange extending radially outward from the first end of the hollow member, and a second flange extending radially outward from the hollow member at a location spaced axially from the second end thereof;

an electromagnetic coil formed of wire, having first and second ends, wound around the hollow member between the first and second flanges;

a power control circuit mounted on a circuit board at the second end of the hollow member for controlling electrical power supplied to the coil.

2. The coil assembly of claim 1, wherein the power control circuit comprises:

a rectifier circuit having a first and a second rectifier circuit input, and having a first and a second rectifier circuit output, the first and second rectifier circuit outputs being coupled to the first and second ends of the coil wire;

first and second power input terminals for connection to any power source having a voltage within a selected range;

a resistor circuit coupled to the first power input terminal and having a resistor circuit output coupled to said first rectifier input, said second rectifier input being coupled to the second power input terminal; and a low resistance circuit having a first end coupled to the resistor circuit input and having a second end coupled to the resistor circuit output, the low resistance circuit including a fusible link, the fusible link being selected to carry current to the rectifier circuit when the power input terminals are coupled to a lower voltage power source and to stop carrying current to the rectifier circuit when the power input terminals are connected to a higher voltage power source.

3. The coil assembly of claim 2, wherein the power control circuit further comprises a coil current protection circuit having a first end coupled to the first rectifier circuit output and a second end coupled to the second rectifier circuit output, the coil current protection circuit carrying current when the power input terminals are connected to said higher voltage power source and not carrying current when the power input terminals are connected to said lower voltage power source.

4. The coil assembly of claim 1, wherein the electromagnetic coil comprises a sufficient number of turns of wire to develop a magnetic flux of more than 10,000 Gauss when carrying a current not greater than 20 milliamps.

5. The coil assembly of claim 1 wherein the electromagnetic coil comprises a sufficient number of turns of wire to develop a magnetomotive force of more than 200 amp-turns when carrying a current not greater than 20 milliamps.

6. The coil assembly of claim 1, wherein the electromagnetic coil comprises a sufficient number of turns of wire to develop a holding force of between about 35–50 lbs. when carrying a current not greater than 20 milliamps.

* * * * *

UNITED STATES PATENT AND TRADEMARK OFFICE

CERTIFICATE OF CORRECTION

PATENT NO. : 5,566,376

DATED : October 15, 1996

INVENTOR(S) : Dye, et al.

It is certified that error appears in the above-indentified patent and that said Letters Patent is hereby corrected as shown below:

On the title page, item [62], delete "abandoned", and replace with --Pat. No. 5,555,484--.

Signed and Sealed this

Fifteenth Day of April, 1997

Bruce Lehman

*Attest:*

BRUCE LEHMAN

*Attesting Officer*

*Commissioner of Patents and Trademarks*